US005499080A

United States Patent [19]

Furuya et al.

[11] Patent Number: 5,499,080

[45] Date of Patent: Mar. 12, 1996

[54] IMAGE FORMING APPARATUS HAVING A VOLTAGE CONTROLLED CONTACT CHARGER

[75] Inventors: Tadashi Furuya; Junji Araya; Hideyuki Yano, all of Yokohama; Harumi Kugoh, Kawasaki, all of Japan

[73] Assignee: Canon Kabushiki Kaisha, Tokyo, Japan

[21] Appl. No.: 172,108

[22] Filed: Dec. 23, 1993

[30] Foreign Application Priority Data

Dec. 24, 1992 [JP] Japan ..... 4-359139

[51] Int. Cl.[6] ..... G03G 15/02

[52] U.S. Cl. ..... 355/208; 355/219

[58] Field of Search ..... 355/208, 219; 361/235

[56] References Cited

U.S. PATENT DOCUMENTS 5,151,736 9/1992 Ohzeki et al. ..... 355/208

5,196,885 3/1993 Takeuchi et al. ..... 355/219

5,229,818 7/1993 Nakahara et al. ..... 355/219 X 5,305,177 4/1994 Aoki et al. ..... 355/219 X

FOREIGN PATENT DOCUMENTS 5-181350 7/1993 Japan .

*Primary Examiner*—Nestor R. Ramirez

*Attorney, Agent, or Firm*—Fitzpatrick, Cella, Harper & Scinto

[57] ABSTRACT

A charging apparatus includes a charging member for charging the member to be charged; a power source for supplying electric power to the charging member; a power source for supplying a constant small DC current to the charging member; and a device for determining a voltage to be applied to the charging member; wherein while the constant small DC current is supplied to the charging member, a voltage supplied to the charging member is detected and in response to the detected voltage, the voltage determining device determines the voltage to be applied to the charging member.

27 Claims, 3 Drawing Sheets

IMAGE FORMING APPARATUS HAVING A VOLTAGE CONTROLLED CONTACT CHARGER

FIELD OF THE INVENTION AND RELATED ART

The present invention relates to a charging apparatus and an image forming apparatus provided with a charging member to which a voltage is applied for charging (or discharging) a member to be charged, such as a photosensitive member.

In recent years, contact type charging apparatuses with special characteristics such as no ozone generation or low power consumption have been attracting public attention and some of them have been put to practical use. In these apparatuses, a conductive charging member is placed in contact with the member to be charged, such as the photosensitive member, and then a voltage is applied to this charging member to trigger an electric discharge to the member to be charged so that the surface of the member to be charged is charged to a predetermined potential.

It is also possible to charge the member to be charged without placing the charging member in contact with the member to be charged. In other words, the charging member may be positioned to hold from the member to be charged, a minute air gap across which the electric discharge occurs from the charging member to the member to be charged, as a necessary amount of charge bias is applied to this charging member. This method can charge the member to be charged in the same manner as the charging member is placed in contact with the member to be charged.

The charging member may be in the form of a roller, a blade, a rod, or a brush, but from the standpoint of charging safety, a roller type charging means is preferably used, in which a conductive roller is employed as the charging member.

When the contact type charging member is used, the member to be charged is charged by the electric discharge from the charging member to the member to be charged and the electric discharge is triggered by applying a voltage exceeding a threshold voltage value. For example, when the charging roller is pressed on a photosensitive member having a 25 μm thick organic photosensitive layer under normal ambient conditions (23° C., 64% RH), the surface potential of the photosensitive member starts increasing as a voltage higher than 640 V is applied to the charging roller, as shown in FIG. 6, and from that point on, it keeps on climbing linearly at an inclination designated by a reference numeral 1 in proportion to the applied voltage. Hereinafter, this voltage is referred to as a charge start voltage $V_{th}$. When the charging member is of non-contact type, $V_{th}$ is larger compared to that of the contact type.

As is evident from the foregoing, what is necessary in order to generate a surface potential $V_d$ on the photosensitive member is to apply a voltage equal to $V_d+V_{th}$ to the charging roller, wherein $V_d$ is a predetermined amount of surface potential necessary for the electrophotography.

This principle can be explained as follows. Referring to FIG. 5, as far as the discharge is concerned, the relation between the micro-gap air layer A between the charging roller 2 and photosensitive drum 1, and the photosensitive drum 1, is expressed as an electric equivalent circuit. The photosensitive drum 1 comprises a photosensitive layer 1*a* and a grounded conductive substrate 1*b* which supports the photosensitive layer 1*a*.

Since the material for the charging member is selected so that under normal ambient conditions, the impedance of the charging roller 2 becomes negligible compared to those of the photosensitive drum and air layer A, the impedance of the roller 2 will not be discussed. Thus, the charging mechanism can be represented by two capacitors $C_1$ and $C_2$.

As a DC voltage V is applied to this equivalent circuit, the voltage is divided between the condensers in proportion to their impedances, and the voltage applied to the air layer A is expressed by the following equation.

$$V_{air}=C_1/(C_1+C_2) \quad (1)$$

The air layer has a breakdown voltage which follows Paschen's law, and when $V_{air}$ exceeds a value expressed by the following equation, the discharge occurs to charge the member to be charged, wherein d (μm) stands for the thickness of the air layer A.

$$312+6.2d\ [V] \quad (2)$$

The discharge occurs for the first time when a quadratic equation of d derived from the Equation (1) and (2) holds a double solution (C2 is also a function of d). A value of V at this moment is equivalent to the charge start voltage $V_{th}$. A thus obtained theoretical value $V_{th}$ is very close to the value obtained through experiments.

However, when the electrostatic capacity $C_1$ changes as the member to be charged is shaved through the course of usage, the above-mentioned charge start voltage (threshold value) $V_{th}$ also changes, and due to this change in $V_{th}$, the charge potential of the member to be charged changes. In the case of the image forming apparatus, since the photosensitive member as the member to be charged is shaved while being used or for some other reason, the electrostatic capacity $C_1$ changes, changing thereby $V_{th}$; therefore, the charge potential deviates from a predetermined value initially set, disturbing the image.

In other words, when an attempt is made to charge the photosensitive drum 1 based on the predescribed contact charge principle, the electrostatic capacity $C_1$ of the photosensitive drum 1 changes, since the photosensitive drum 1 is shaved through the course of usage; as a result, $V_{th}$ changes. In practical terms, $C_1$ is expressed by the following equation; therefore, $C_1$ increases as the photosensitive member becomes thinner due to usage.

$$C_1=\tau S/t$$

(τ: dielectric constant of photosensitive member, S: discharge area (constant), t: thickness of photosensitive member)

On the other hand, since the impedance of the photosensitive drum 1 is proportional to the reciprocal of $C_1$, the voltage applied to the photosensitive drum 1 decreases, and conversely, the voltage applied to the air layer A increases. As a result, when the same voltage is applied after an extended usage, it is easier for the discharge to occur, which naturally makes the value of $V_{th}$ smaller.

Now, under low temperature and low humidity conditions (15° C., 10% RH, hereinafter, called L/L environment), which were not referred to in the description of the preceding model, the electrostatic capacity of the charging roller 2, which could be ignored in the previously described normal environment (N/N environment), changes, increasing thereby the impedance; therefore, a higher voltage is required to trigger a discharge. As a result, $V_{th}$ increases.

As was stated in the foregoing, when the image forming apparatus employing the contact type charging system is constant-voltage controlled using a voltage value obtained at the beginning of the image forming operation under normal conditions, with no regard to such factors as how many sheets of paper had been fed or the environmental conditions, $V_{th}$ becomes smaller after extended operations. Therefore, $V_d$ increases. Further, $V_d$ decreases under the L/L environment. In other words, there is a problem such that the resultant image changes in either case.

SUMMARY OF THE INVENTION

Accordingly, a primary object of the present invention is to provide a charging apparatus or an image forming apparatus capable of keeping constant the surface potential of a member to be charged even when the electrostatic capacity of the member to be charged or a charging member changes because the member to be charged is shaved while being used or due to the environmental factors.

Another object of the present invention is to provide a charging apparatus and an image forming apparatus which are capable of charging the member to be charged, regardless of the changes in the charge start voltage of the member to be charged.

These and other objects, features and advantages of the present invention will become more apparent upon a consideration of the following description of the preferred embodiments of the present invention, taken in-conjunction with the accompanying drawings.

DETAILED DESCRIPTION OF THE PREFERRED EMBODIMENTS

Figure 1:
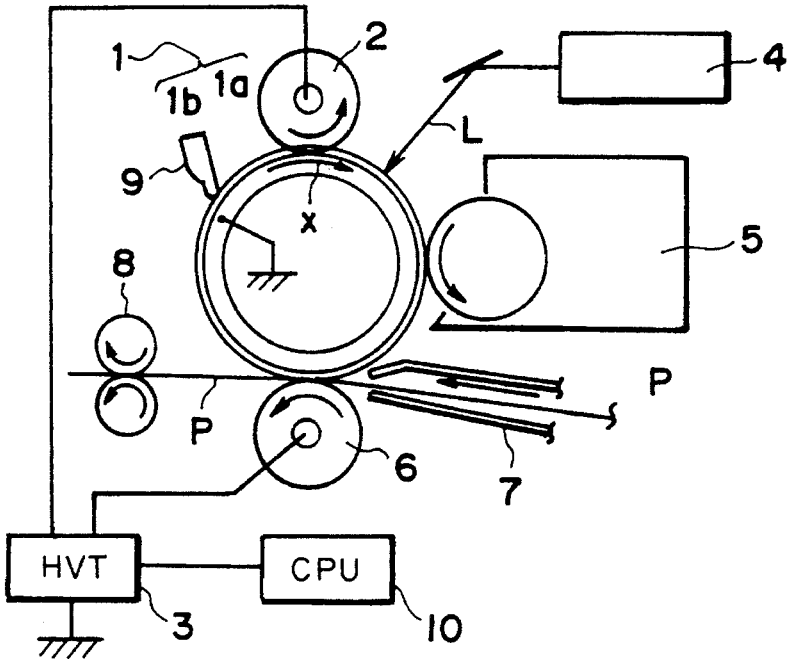
FIG. 1 is a schematic section of a preferred embodiment of the image forming apparatus (laser beam printer) according to the present invention, depicting the general structure.

FIG. 1 is a schematic section of a preferred embodiment of the image forming apparatus according to the present invention. This image forming apparatus is a laser beam printer employing a transfer type electrophotographic process.

A reference numeral 1 designates a photosensitive drum as an image bearing member (member to be charged). This photosensitive drum 1 is a cylinder having a diameter of 30 mm and is rotatively driven about the central axis which runs in the direction perpendicular to the surface of this page, in the clockwise direction X indicated by an arrow at a predetermined process speed (peripheral velocity). In the case of this embodiment, it is rotated at 23 mm/sec. The photosensitive drum 1 comprises an organic photoconductive layer 1*a* which is 25 mm thick, and a grounded conductive substrate 1*b* which supports the organic photoconductive layer.

A reference numeral 2 designates a charge roller as a charging member placed in contact with the photosensitive drum 1. This charge roller 2 is rotated by the rotation of the photosensitive drum 1 and as a predetermined amount of charge bias voltage is applied to it from a voltage supplying member 3 (HVT, power source), the peripheral surface of the rotary photosensitive drum 1 is uniformly charged to a predetermined polarity and potential (in this embodiment, to the negative polarity).

Next, a laser beam L modulated in response to imaging signals is outputted from a laser beam scanner 4 to irradiate (expose by scanning) the charged surface of the rotary photosensitive drum 1, attenuating thereby the potentials at exposed areas, whereby an electrostatic latent image is formed.

As the photosensitive drum 1 rotates, the latent image reaches a developing station which faces a developing device 5, where the toner charged to the negative polarity is supplied from the developing device, whereby the latent image is developed through the reversal development process into a toner image.

Further, a conductive transfer roller 6 is positioned in contact with the photosensitive drum 1, with a predetermined pressure, on the downstream side of the developing device 5 with reference to the rotating direction of the photosensitive drum 1, forming a nip as a transfer station between two components 1 and 6.

When the toner image developed on the surface of the photosensitive drum 1 reaches the above-mentioned transfer station as the photosensitive drum 1 rotates, a transfer material P is delivered to this transfer station by a guide 7 in synchronization with the toner image. Meanwhile, a voltage of a predetermined value is applied to the transfer roller 6 by voltage supplying member 3 at a predetermined timing, whereby the toner image is transferred from the surface of the photosensitive drum 1 to the transfer material P.

The transfer material P imparted with the toner image in the transfer station is conveyed to a fixing apparatus 8, where the toner image is fixed, and is discharged from the image forming apparatus.

On the other hand, the residual toner on the surface of the photosensitive drum 1 is scraped off by a urethane counter blade 9 (cleaning blade). Thus, the surface of the photosensitive drum 1 is cleaned and prepared for next image forming operation.

A reference numeral 10 designates a control unit (CPU), which controls the power source 3 with regard to the following functions:

(a) To flow a micro-DC $\Delta I_0$ between the charge roller 2 and photosensitive drum 1.

(b) To measure a voltage $V_{r-d}$ between the charge roller 2 and photosensitive member when the micro-DC $\Delta I_0$ is flowed.

(c) To apply a predetermined voltage V to the charge roller 2 so that the photosensitive drum is charged to a predetermined potential $V_d$.

As regards (a), the current outputted from the power source 3 is $\Delta I_0$ which is constant and this current $\Delta I_0$ is supplied to the charge roller 2. With regard to (b), the voltage $V_{r-d}$ is equivalent to the output voltage of the power source 3 while the current $\Delta I_0$ is flowed. As regards (c), it is preferred that the period during which the voltage V is applied to the charge roller 2 is equal to the period during which the charge roller 2 charges the photosensitive member, to form the latent image on the photosensitive member. Further, it is preferred for the charge roller 2 to be constant-voltage controlled by the power source 3, using the voltage V. This is because when the charge roller 2 is constant-current controlled with the presence of pinholes on the photosensitive member, an excessive amount of current flows toward the pinholes; therefore, it is liable for the surface of the photosensitive member 1 to be streaked with charge failure.

Figure 2:
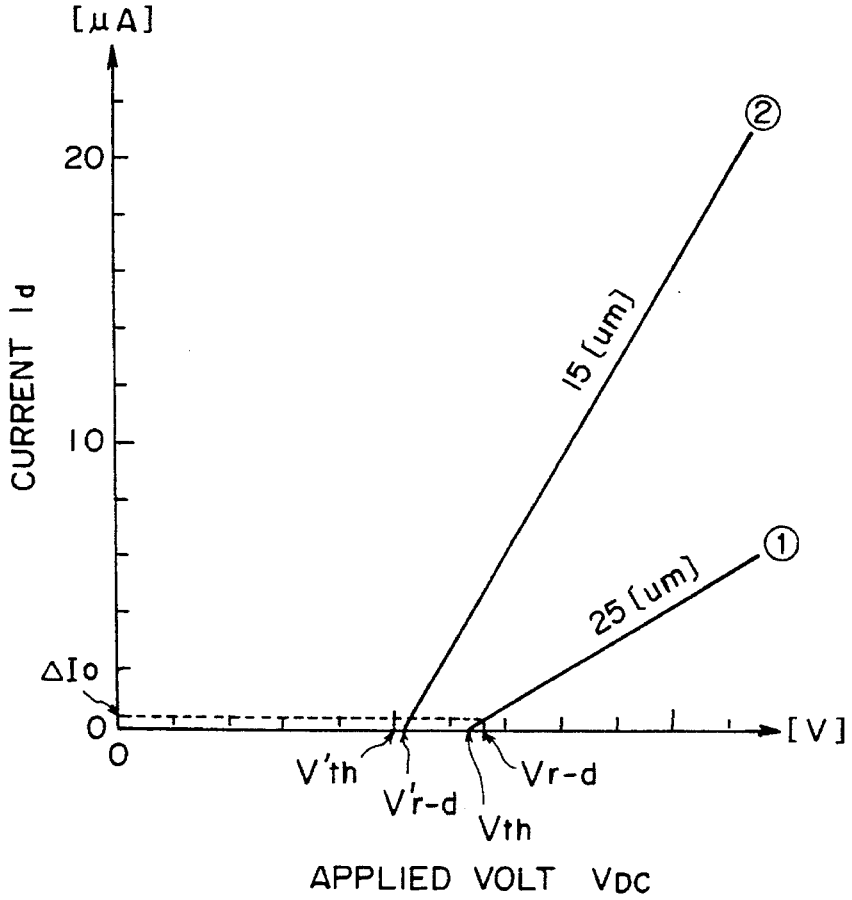
FIG. 2 is a graph showing the relation between the voltage VDC applied to the charge roller and the current $I_d$ flowing to the photosensitive drum.

The relation among the parameters related to the above-mentioned functions (a) to (c) can be graphed as shown in FIG. 2.

The discharge start voltage $V_{th}$ is the minimum voltage necessary to initiate the charging of the photosensitive member and can be determined by measuring the surface potential $V_d$ of the photosensitive member 1 and the applied voltage $V_{DC}$, but assembling a potentiometer into the apparatus complicates the structure and is less favorable from the standpoint of costs.

Therefore, a current $I_d$ which flows through the photosensitive member and can be easily measured is used. There is the following relation between the current $I_d$ which flows through the photosensitive member 1 and the surface potential $V_d$ of the photosensitive member, wherein $C_1$ is the electrostatic capacity of the photosensitive member.

$$I=dQ/dt, \text{ and } Q=C_1 \cdot V_d;$$

$$\text{therefore, } \int Id \cdot dt=C_1 \cdot V_d \quad (3)$$

When the relation between the photosensitive current $I_d$ and the applied voltage VDC is given in the form of a graph, based on the linear relation between the photosensitive member current $I_d$ and applied voltage $V_{DC}$, a linear graph (1) in FIG. 2 is obtained, wherein the inclination of this graph 1 is determined by the electrostatic capacity of the photosensitive member 1 and the graph (1) starts running upward from a point where the applied voltage $V_{DC}$ is $V_{th}$. With reference to this graph, it will be understood that the discharge start voltage $V_{th}$ of the photosensitive member can be known by measuring the photosensitive member current $I_d$ instead of measuring the surface potential $V_d$ of the photosensitive member.

Further, the linear graph (2) represents a different relation between the applied voltage $V_{DC}$ and photosensitive current $I_d$ which has been caused by a change in the electrostatic capacity of the photosensitive member due to the shaving of the photosensitive member through the course of continuous operation. After such a change occurs, the discharge start voltage $V_{th}$ shifts to $V_{th}'$, which makes it impossible for the photosensitive member to be charged to a proper potential by the charging apparatus comprising a constant-voltage controlled charging member.

Therefore, a correction is made in the following manner: a potential $V'_{r-d}$ between the charge roller 2 and photosensitive member 1 is measured while the micro-current $\Delta I_0$ is flowed from the voltage supplying member 3 and the obtained value is corrected by the control unit 10, assuming that the obtained value is an approximation of $V_{th}'$. Then, a voltage having a value of ($V_d+V'_{r-d}$ $V_d+V_{th}'$) is applied to the charging member by the power source 3.

Thus, even when the thickness of the photosensitive layer changes, the potential on the photosensitive member 1 is maintained at the same level by the application of the corrected voltage. Further, the smaller the micro-current $\Delta I_0$ is made, the smaller the difference between $V_{th}'$ and $V'_{r-d}$ becomes; therefore, the correction accuracy can be improved.

Referring to FIG. 2, the linear graph (1) refers to the case in which the discharge start voltage $V_{th}$ is 640 V, that is, when the photosensitive member is at the initial stage of its usage (carrier transfer layer of the photosensitive member 1 is 25 μm thick) and the linear graph (2) refers to the case in which the discharge start voltage $V_{th}'$ is 520 V, that is, when the photosensitive member has worn (CT layer thickness is 15 μm). The CT layer is laminated on the charge generating layer.

When the charging member is constant-voltage controlled regardless of the change in the thickness of the photosensitive layer, the surface voltage $V_d$ after the photosensitive member is worn becomes different by 120 V (=640 V−520 V) since the applied voltage V ($=V_d+V_{th}$) is set in correspondence with $V_{th}$ which is the charge start voltage at the initial stage of usage; therefore, deterioration of image quality is invited.

When the voltage between the photosensitive member 1 and charge roller 2 was measured while a micro-current $\Delta I_0$ of 0.2 μA was flowed, the results were:

$V_{r-d}$=658 V at the initial stage (CT layer=25 μm)

$V'_{r-d}$=525 V after usage (CT layer=15 μm)

Both $V_{r-d}$ and $V'_{r-d}$ were not much different from their own discharge start values and these $V_{r-d}$ and $V'_{r-d}$ corresponding to this micro-current were used to determine the voltage to be applied.

For example, when a charge potential Vdo of 700 V was wanted, the voltage to be applied at the initial stage of usage could be determined to be:

$$E=V_{r-d}+Vdo=1358\ V$$

and the voltage to be applied after the CT layer was worn could be determined to be:

$$E'=V'_{r-d}+Vdo=1225\ V$$

The images obtained by applying these voltages were excellent both when the photosensitive member was at the initial stage of usage and when it was at the end stage. As for the amplitude of the micro-current $\Delta I_0$, as long as it was below 0.5 μA, there were no practical problems and excellent images were produced. As to the timing with which the micro-current is to be flowed, it is preferred to be every time the power of the printer is turned on and before the latent image is formed on the photosensitive member.

Figure 3:
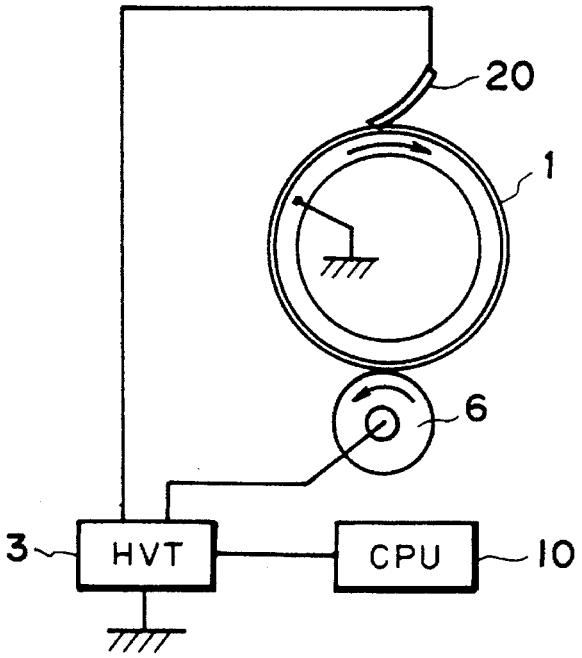
FIG. 3 is a schematic section of the second embodiment of the image forming apparatus in which the charging member is in the form of a charging blade.

Embodiment 2 (FIG. 3)

In the preceding embodiment 1, a charge roller was used as the contact type charging member 2 but the charging member may be in the form of a blade.

Referring to FIG. 3, the charge roller 2 which is the charging member in the apparatus shown in FIG. 1 is replaced by a charge blade 20.

The charge blade 20 comprises a urethane blade processed to be conductive and a coated layer of urethane paint (commercial name: EMRALON) and the resistance value is adjusted to be approximately 105 Ω. The charge blade 20 is oriented in a manner such that its supported end is positioned on the downstream side of the free end with reference to the direction of the photosensitive drum rotation, and is pressed upon the photosensitive member 1, with a contact pressure of 500 g, in a manner so as to slide on the surface of the photosensitive member 1. Therefore, the photosensitive member is shaved more compared to Embodiment 1 in which the charge roller 2 is rotated by the rotation of the drum 1. In other words, the change in the discharge start voltage of the photosensitive member is more drastic.

For such a charging apparatus, the control method described in (a) to (c) in the foregoing is extremely effective. The details of the control method are the same as in Embodiment 1, wherein the produced images were excellent both before and after the extended image forming operation (durability test operation).

The results of measuring how much the photosensitive member was shaved while the image forming operation was carried out are as follows; in the apparatus comprising the charge roller 2 in Embodiment 1, 10 μm was shaved for every approximately 8,000 sheets of A4 size transfer material and in the apparatus comprising a charge blade 20, 10 μm was shaved for every 6,000 sheets of the A4 size transfer material. Therefore, the present invention is especially effective to give to the apparatus with the charge blade 20 the same degree of performance stability as the apparatus in Embodiment 1.

Figure 4:
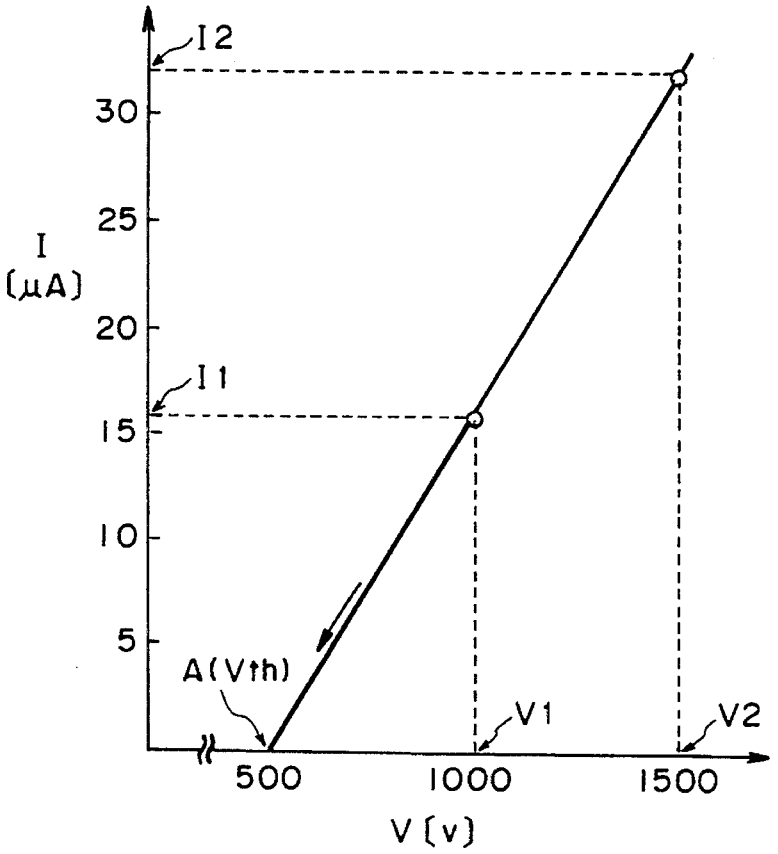
FIG. 4 is a graph depicting how control is executed in the third embodiment of the present invention.
Figure 5:
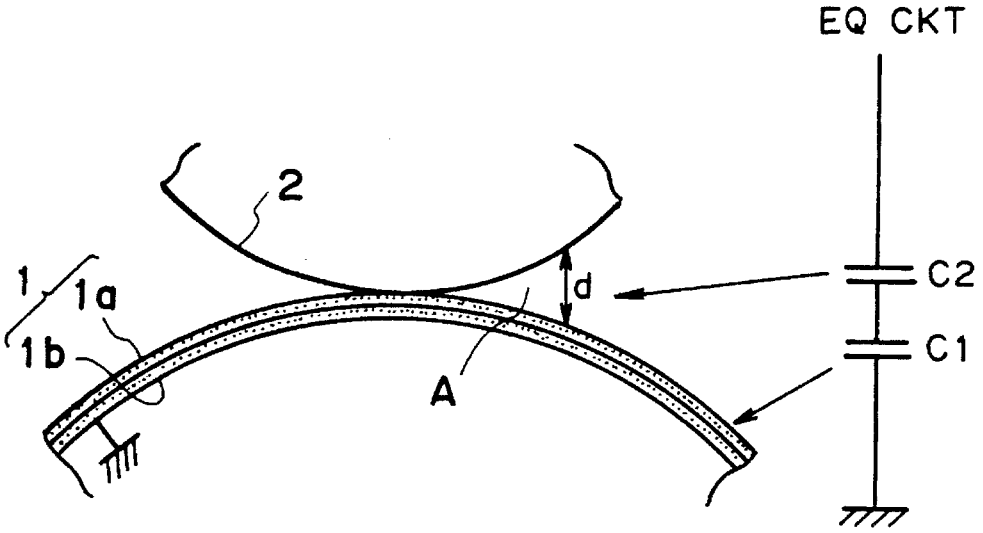
FIG. 5 is an equivalent circuit for describing the discharge.
Figure 6:
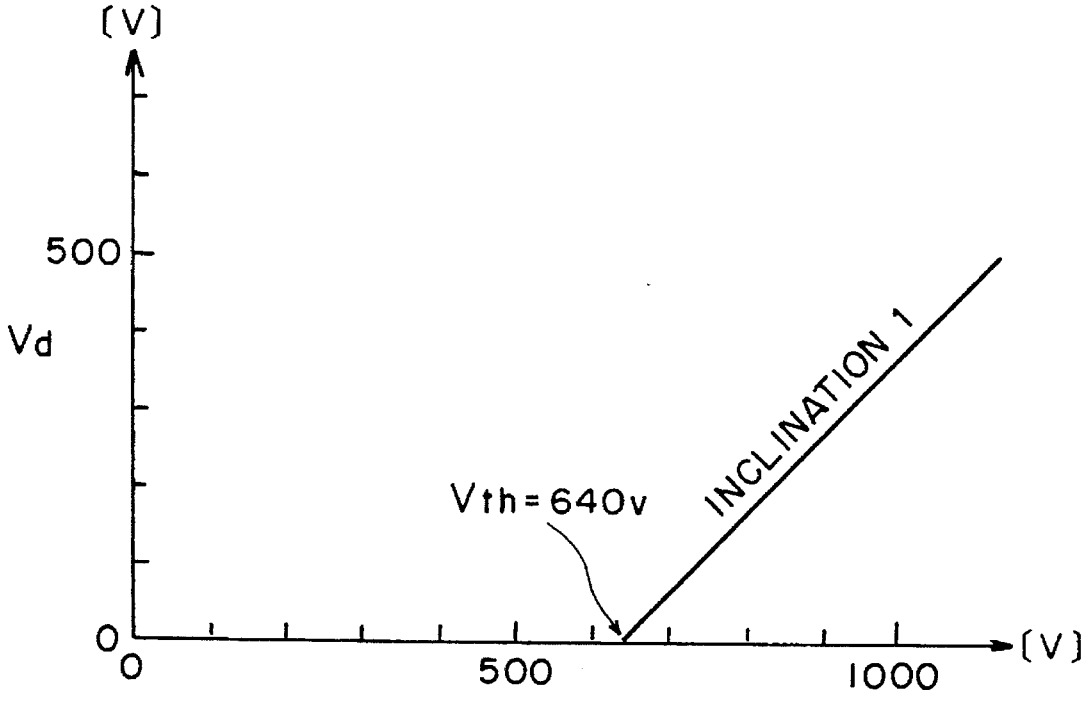
FIG. 6 is a graph showing the relation between the voltage $V_{DC}$ applied to the charging roller and the surface potential $V_d$ of the photosensitive drum.

Embodiment 3 (FIG. 4)

In this embodiment, the printer is the same as the one in FIG. 1, wherein an OPC drum is employed as the photosensitive drum 1, which comprises an aluminum drum with a diameter of 30 mm, a charge generating layer placed on the aluminum drum, and a 25 μm thick carrier transfer layer coated thereon. The process speed of the drum is 95 mm/sec.

For the photosensitive member of this embodiment, polycarbonate resin is used as a binder, and is shaved by a minute amount as the sheets are fed during the continuous operation.

The charge roller 2 comprises two layers placed on the core metal to which the voltage is applied: a conductive elastic layer and a high resistance layer. This arrangement is made to prevent the phenomenon that when pinholes develop on the photosensitive drum 1, the charge current concentrates to the areas of the pinholes, which decreases the potential of the roller surface, causing thereby transverse streaks of charge failure.

A developing device 5 employs the jumping developing method, wherein the electrostatic latent image on the photosensitive member 1 undergoes the reversal development process using a monocomponent magnetic toner. Thus, the exposed areas are visualized by the toner. During the transfer operation, a voltage of 3 KV is applied to the transfer roller 6.

Next, how the voltage applied to the charge roller 2 is controlled will be described. As described in the foregoing, when a DC voltage is applied to the charge roller 2, charging occurs if the applied voltage is higher than the charge start voltage $V_{th}$, and from that point on, the surface potential of the photosensitive member increases in proportion to the amount of increase in the applied voltage. This implies that if it can be assumed that the effects of the ambient condition and shaving of the photosensitive member are negligible, all that is needed is to control the charge roller 2 using a voltage obtained by the addition of $V_{th}$ to the desired surface potential $V_d$ of the photosensitive member. However, as is evident from Table 1, when the ambient conditions are changed or the photosensitive member is shaved, $V_{th}$ changes. Therefore, when the charge roller 2 is always under the constant-voltage control, the value of $V_d$ changes.

TABLE 1

| Film thickness | Initial 25 μm | | After durability test operation 15 μm | |
|---|---|---|---|---|
| Environment | L/L | N/N | L/L | N/N |
| $V_{th}$ | 680 V | 640 V | 560 V | 520 V |

As shown in Table 1, there is a difference of 160 V in $V_d$ between the end stage of usage under the N/N environment and the initial stage under the L/L environment.

When, assuming that the printing operation is at the initial stage under the normal environment, the constant-voltage control is carried out with an estimated $V_{th}$ value of 640 V, the value of $V_d$ declines in the L/L environment, causing thereby the foggy image. In addition, the value of $V_d$ becomes substantially high at the end stage of the operation, increasing thereby the image density.

In order to detect the change in $V_{th}$, a potentiometer may be provided in the printer main assembly for measuring the surface potential of the photosensitive member but this not only increases the cost but also creates other problems such as a need for hardware such as a separate power source.

Because of the reasons presented above, the voltage applied to the charge roller 2 and the current flowed thereby are detected, and their relation is used to estimate the value of $V_{th}$.

In practical terms, two voltages $V_1$ and $V_2$ which are higher than the charge start voltage $V_{th}$ are applied to the charge roller 2 and the current $I_1$ and $I_2$ flowing correspondingly are measured. At this time, unless the potential of the photosensitive member has a definite value, the relation between the charge potential and charge current cannot be determined; therefore, the measurement of the currents which flow while the voltages $V_1$ and $V_2$ are applied is carried out after the potential of the photosensitive member is set to zero by exposing the photosensitive member with use of the scanner 4.

In FIG. 4, the value of $V_{th}$ is indicated by a point A which designates the discharge start point; therefore, the desired value of $V_{th}$ can be calculated by substituting $I_1$ and $I_2$ in the following equation, with the current values measured while the voltage $V_1$ and $V_2$ are applied, respectively, and also, substituting I with 0.

$$I-I_1=\{(I_2-I_1)/(V_2-V_1)\}(V-V_1)\quad V_{th}=V_{1-I1}(V_2-V_1)/(I_2-I_1)$$

Then, a voltage Vc which is obtained by adding a desired $V_d$ to $V_{th}$ calculated in this manner is applied to the charge roller 2 to constant-voltage control the charge roller 2, which makes it possible to stabilize $V_d$ whether or not the photosensitive member 1 is shaved and whether or not the ambient condition changes.

In practical terms, such a procedure as described in the foregoing is carried out during the pre-rotation of the photosensitive member, that is, before the formation of the latent image starts, so that the voltage Vc can be applied while the latent image is formed in response to the image forming data, to assure that the potential of the charged photosensitive member remains at $V_d$.

Described below is an example of actual image forming operation, in which the above described control was executed under the N/N environment, using a photosensitive drum, the CT layer of which had been shaved down to a thickness of 15 μm. During the pre-rotation period, a $V_1$ of 1,000 V and a $V_2$ of 1,500 V were applied and the obtained currents were 16 μm and 32 μm, respectively. While the measurements were taken, the photosensitive member was continuously exposed so that the potential of the photosensitive member before it was charged remains at 0 V.

As to the duration of voltage application, each voltage was applied for a duration equivalent to a single rotation of the photosensitive drum 1 and the current values measured during this period was averaged.

When $I_1$ and $I_2$ in the above equation were substituted by the measured values, 500 V was obtained as $V_{th}$ and then, 700 V which was the target value of $V_d$ was added to this 500 V, obtaining 1,200 V, which was determined to be the voltage to be applied during the image forming operation.

When actual image forming operations were carried out using this voltage, excellent images could be produced, wherein the measured surface potential of the photosensitive member at this time was 680 V, which was close to the estimated value.

On the other hand, in the different image forming operation in which the present invention was not used and 1,340 V based on a $V_{th}$ of 640 V which corresponds to the initial stage of the photosensitive member usage under the N/N environment was applied to the charge roller 2 to charge the photosensitive drum with the 15 μm thick CT layer, a result of 820 V was obtained as $V_d$. Therefore, the reverse contrast increased in relation to the developing bias; the resultant image suffered from the reversal fog; and also, the image density was substantially reduced, fading thereby fine lines.

As described in the foregoing, when the charging member is constant-voltage controlled regardless of the conditions of the photosensitive layer and ambience, the image quality is liable to deteriorate depending on the duration of the image forming operation and the changes in ambience. However, it is possible to eliminate this problem by detecting the charge start voltage.

As for the measurement of the currents corresponding to the application of voltages $V_1$ and $V_2$, it is preferred to be carried out each time the power source of a printer is turned on.

Further, in the embodiments described hereinbefore, the charging member was arranged to contact the photosensitive member but it may be arranged to make no contact, holding a micro-air gap of less than 1,000 μm. Here, when the micro-air gap is provided, the charge start voltage is higher compared to when there is a contact.

While the invention has been described with reference to the structures disclosed herein, it is not confined to the details set forth and this application is intended to cover such modifications or changes as may come within the purposes of the improvements or the scope of the following claims.

What is claimed is:

1. A charging apparatus comprising:

a charging member for charging a member to be charged;

a power source for supplying electric power to said charging member;

means for supplying a constant small Dc current to said charging member; and means for determining a voltage to be applied to said charging member;

wherein while the constant small DC current is supplied to said charging member, a voltage supplied to said charging member is detected and in response to said detected voltage, said voltage determining means determines the voltage to be applied to said charging member.

2. A charging apparatus according to claim 1, wherein said constant DC current is not more than 0.5 μA.

3. A charging apparatus according to claim 1, wherein said charging member is contactable to said member to be charged.

4. A charging apparatus according to claim 1, wherein said charging member is positioned such that a small gap is formed between said charging member and said member to be charged.

5. An image forming apparatus comprising:

an image bearing member for bearing an image;

a charging member for charging said image bearing member;

a power source for supplying electric power to said charging member;

means for supplying a constant small DC current to said charging member; and means for determining a voltage to be applied to said charging member;

wherein while the constant small DC current is supplied to said charging member, a voltage supplied to said charging member is detected and in response to said detected voltage, said voltage determining means determines the voltage to be applied to said charging member.

6. An image forming apparatus according to claim 5, wherein said constant DC current is not more than 0.5 μA.

7. An image forming apparatus according to claim 5 or 6, wherein said charging member is constant-voltage controlled using said voltage determined by said voltage determining means.

8. An apparatus according to any one of claim 7, wherein said charging member is contactable to said image bearing member.

9. An image forming apparatus according to claim 5, wherein a latent image can be formed on said image bearing member, with use of said charging member, and said voltage determined by said voltage determining means is applied to said charging member while the latent image is formed.

10. An image forming apparatus according to claim 9, wherein while the latent image is formed, said charging member is constant-voltage controlled using said voltage determined by said voltage determining means.

11. An image forming apparatus according to claim 9 or 10, wherein said constant DC current is supplied before the latent image is formed.

12. An apparatus according to claim 11, wherein said charging member is contactable to said image bearing member.

13. An image forming apparatus according to claim 5, wherein said voltage determined by said voltage determining means is substantially a sum of the voltage supplied to said charging member while said constant DC current is supplied and the potential to which said image bearing member is charged by said charging member.

14. An image forming apparatus according to claim 5, wherein said charging member is contactable to said image bearing member.

15. An image forming apparatus according to claim 5 or 14, wherein said charging member is in the form of a roller.

16. An image forming apparatus according to claim 5, wherein said charging member is positioned such that a small gap is formed between said charging member and said image bearing member.

17. An image forming apparatus according to claim 16, wherein said charging member is positioned such that it forms a micro-air gap of less than 1,000 μm between said charging member and said image bearing member.

18. An image forming apparatus comprising:

an image bearing member for bearing an image;

a charging member for charging said image bearing member in order to form a latent image on said image bearing member;

a power source for supplying electric power to said charging member;

means for supplying to said charging member, first and second voltages which are different from each other; and means for determining a third voltage to be applied to said charging member;

wherein while said first and second voltages are supplied to said charging member, corresponding first and second currents flowing through said charging member are detected and in response to said detected first and second currents, said voltage determining means determines the third voltage to be applied to said charging member.

19. An image forming apparatus according to claim 18, wherein said third voltage determined by said voltage determining means is applied to said charging member while the latent image is formed.

20. An image forming apparatus according to claim 18, wherein while the latent image is formed, said charging member is constant-voltage controlled using said third voltage determined by said voltage determining means.

21. An image forming apparatus according to claim 18, wherein said first and second currents are detected before the image is formed.

22. An image forming apparatus according to claim 18, wherein said third voltage determined by said voltage determining means is substantially equal to:

$$V_1-I_1(V_2-V_1)/(I_2-I_1)+V_d$$

wherein $V_1$ is said first voltage; $V_2$ is second voltage; $I_1$ is first current; $I_2$ is second current; and $V_d$ is the potential of said image bearing member charged by said charging member.

23. An apparatus according to any one of claims 6, 9, 10, 13, or 19–22, wherein said charging member is contactable to said image bearing member.

24. An image forming apparatus according to claim 18, wherein said charging member is contactable said image bearing member.

25. An image forming apparatus according to claim 18 or 24, wherein said charging member is in the form of a roller.

26. An image forming apparatus according to claim 18, wherein said charging member is positioned such that a small gap is formed between said charging member and said image bearing member.

27. An image forming apparatus according to claim 26, wherein said charging member is positioned such that it forms a micro-air gap of less than 1,000 μm between said charging member and said image bearing member.

* * * * *

UNITED STATES PATENT AND TRADEMARK OFFICE

CERTIFICATE OF CORRECTION

PATENT NO. : 5,499,080
DATED : March 12, 1996
INVENTOR(S) : Tadashi Furuya, et. al.

It is certified that error appears in the above-indentified patent and that said Letters Patent is hereby corrected as shown below:

COLUMN 5

Line 31, "voltage VDC" should read --voltage $V_{DC}$--.

COLUMN 8

Line 46, "$V_{th} = V_{1-II}(V_2-V_1)/(I_2-I_1)$" should read --$V_{th} = V_1-I_1\ (V_2-V_1)/(I_2-I_1)$--

COLUMN 9

Line 55, "Dc" should read --DC--.

COLUMN 10

Line 31, "any one of" should be deleted.

Signed and Sealed this

Second Day of July, 1996

Bruce Lehman

*Attest:*

BRUCE LEHMAN

*Attesting Officer*

*Commissioner of Patents and Trademarks*